US005433353A

United States Patent [19]

Flinn

[11] Patent Number: 5,433,353

[45] Date of Patent: Jul. 18, 1995

[54] FLUID STORAGE AND DISPENSING CONTAINER HAVING CHECK VALVE

[76] Inventor: Christopher R. Flinn, P.O. Box 5545, Burlington, Vt. 05402

[21] Appl. No.: 307,394

[22] Filed: Sep. 16, 1994

Related U.S. Application Data

[63] Continuation of Ser. No. 42,574, Apr. 5, 1993, abandoned, which is a continuation-in-part of Ser. No. 795,530, Nov. 21, 1991, abandoned.

[51] Int. Cl.[6] ..... B67D 3/00

[52] U.S. Cl. ..... 222/481; 222/206; 220/703

[58] Field of Search ..... 222/206–212, 222/481, 481.5, 478, 181, 185; 220/703

[56] References Cited

U.S. PATENT DOCUMENTS

| | | | |
|---|---|---|---|
| 886,984 | 5/1908 | Jopling | 222/212 X |
| 2,543,163 | 2/1951 | Greiner | 222/481 |
| 2,715,980 | 8/1955 | Frick | 222/212 X |
| 2,729,505 | 1/1956 | Harvey | 222/212 X |
| 2,851,201 | 9/1958 | Poitras et al. | 222/481 |
| 2,876,935 | 3/1959 | Lindberg | 222/212 X |
| 2,888,685 | 6/1959 | Giangrosso et al. | 222/481 X |
| 2,898,007 | 8/1959 | Gassaway | 222/212 |
| 4,842,165 | 6/1989 | Van Coney | 222/212 X |
| 5,079,013 | 1/1992 | Belanger | 222/481.5 X |
| 5,133,482 | 7/1992 | Burrows et al. | 222/185 |
| 5,165,578 | 11/1992 | Laible | 222/481 X |
| 5,169,035 | 12/1992 | Imbery, Jr. | 222/481.5 X |
| 5,186,559 | 2/1993 | Fu | 222/212 X |
| 5,232,110 | 8/1993 | Purnell | 222/481 X |

*Primary Examiner*—Andres Kashnikow
*Assistant Examiner*—Kenneth R. DeRosa
*Attorney, Agent, or Firm*—Fitch, Even, Tabin & Flannery

[57] ABSTRACT

The bottle is designed for use in holding fluids, such as milk, water and can be used with all forms of physical activity and has a one way check valve positioned at the end opposite the bottle's opening. The valve is used to provide a constant pressure and a steady stream of water when the rider turns the bottle upside down, even during the operation of the bicycle. The valve allows air into the bottle, but does not allow fluid to exit through the valve.

7 Claims, 2 Drawing Sheets

FLUID STORAGE AND DISPENSING CONTAINER HAVING CHECK VALVE

This is a continuation of U.S. patent application Ser. No. 042,574 filed Apr. 5, 1993, which is a continuation-in-part of U.S. patent application Ser. No. 795,530 filed Nov. 21, 1991, now abandoned.

BACKGROUND OF THE INVENTION

This invention pertains to flexible bottle means, and in particular to such flexible bottle means with built in check valve for use in holding fluids, such as milk or water and in many activities.

Bottles that are used while individuals are bicycling or running are well known in athletic circles. It is known in the art that there are a number of difficulties that are present when trying to use current state of the art water bottles. One of the difficulties is the problem of maintaining one's balance while squeezing the bottle to force fluid from the bottle. Another of the difficulties experienced by the user is getting a mixture of air and water or air only when the bottle is squeezed. This causes the individual's breathing to be disrupted which causes additional problems. Other problems exist with baby bottles and the like, with air getting in the fluid stream.

Examples of these type devices include the United States Patent issued to Champagne on Mar. 12, 1991, U.S. Pat. No. 4,998,652 for a Bicycle Clamp On Water Bottle Bosses and the United States Patent issued to Trimble on 18 Sep. 1990, U.S. Pat. No. 4,957,227 for Saddle Mounted Bicycle Water Bottle Carrier. The general function of these references and a number of others in the art is the comfortable positioning of a water bottle for a bicycle, so that individuals can comfortably grasp them while riding. This happens because bicycles, especially racing bicycles can be very unstable at the speeds they are used at, when reaching with one hand for the water bottle. Other United States Patents issued to Frick, U.S. Pat. No. 2,715,980, issued in August 1955, and Lindberg, U.S. Pat. No. 2,876,935 show devices that require pressure from squeezing to operate. Lindberg has a multi chambered unit that has springs that require pressure to overcome. Frick has a collapsible bag that contains the liquid and air never comes in contact with the liquid. What these references don't deal with is the problem of having to squeeze the bottle a number of times to get fluid to come out on a constant basis. This can cause a difficult situation because the individual is not concentrating on his or her activity.

Clearly, it is desirable for a bottle with built in check valve that can be used with comfort in all situations and provide a constant steam of fluid by simply inverting the container. It is the object of this invention, then to set forth a bottle with built in check valve which avoids the disadvantages limitations, above-recited, which obtain in prior water bottles. It is also the object of this invention to teach a bottle with built in check valve that can be positioned on any standard bicycle.

SUMMARY OF THE INVENTION

Particularly, it is the object of this invention to set forth a bottle means with built in check valve, for use by individuals engaged in physical activities, comprising bottle means; said bottle means further comprising a single, one piece reservoir unit which will allow flow of said fluid whenever said bottle means is inverted; said bottle means comprising flexible material for allowing the user to squeeze said flexible material to increase the flow of said fluid; said bottle means having narrowed neck means; said bottle means further having removable cap means; said cap means having first means positioned around said narrowed neck means for attaching said cap means; said cap means further having second means for connecting said cap means to said first means; said cap means further having fluid flow valve means for restricting flow of said fluid when said bottle means is inverted; and said bottle means further having a one way valve means directly entering said single one piece reservoir unit for permitting direct contact between said fluid and in said reservoir and said air entering said one way valve means and said one way valve means being positioned at the end opposite said cap means.

BRIEF DESCRIPTION OF THE INVENTION

Further objects and features of this invention will become more apparent by reference to the following description taken in conjunction with the accompanying figures, in which.

DESCRIPTION OF THE PREFERRED EMBODIMENTS

Figure 1:
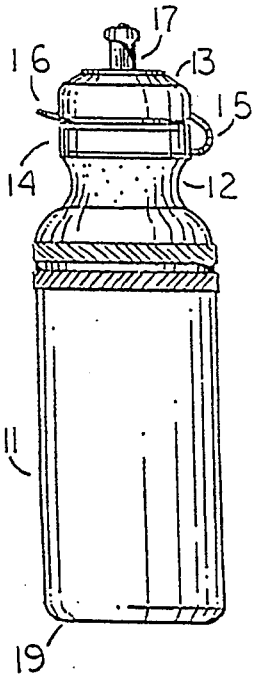
FIG. 1 is a side (either) elevational view of the novel bottle means with built in check valve.
Figure 2:
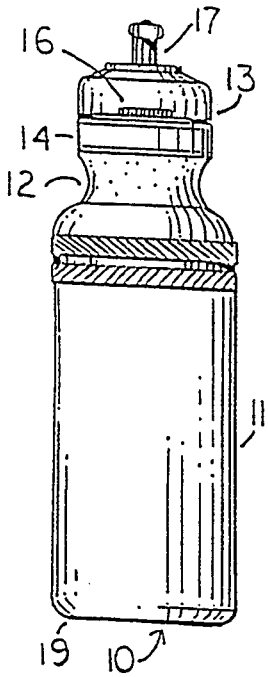
FIG. 2 is a frontal view thereof.
Figure 3:
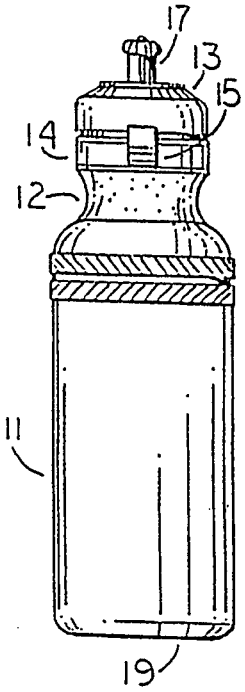
FIG. 3 is a rear view thereof.
Figure 4:
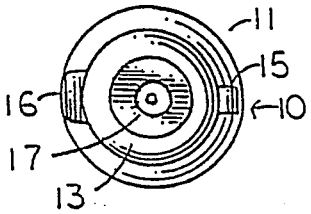
FIG. 4 is a top plan view thereof.
Figure 5:
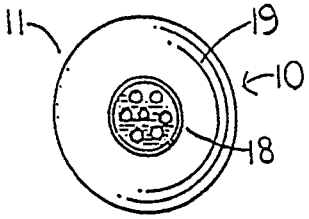
FIG. 5 is a bottom plan view thereof.
Figure 6:
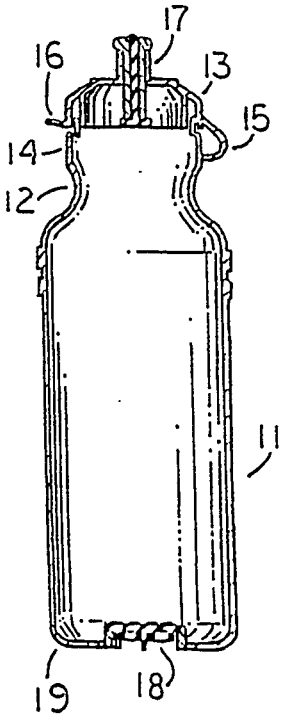
FIG. 6 is a cross-sectional view of the novel means taken along line 6—6 of FIG. 1.

One of the objects of the water bottle of the present invention is to prevent air from flowing inwardly into the container through the fluid discharge opening 20 upon displacement of fluid from the container through the fluid discharge opening 20 in order to effect a steady, uninterrupted fluid flow upon inversion of the container, both with and without squeezing of the container housing 11. Air flow into the container through the fluid discharge opening 20 simultaneous with fluid discharge from the container through the fluid discharge opening 20 slows or interrupts the flow of fluid from the container through the fluid discharge opening 20. To prevent air flow into the container through the fluid discharge opening 20, an important characteristic of the water bottle of the present invention is that the fluid discharge opening 20, at which the shut off valve 17 is located, be sufficiently small or narrow to prevent air from readily entering into the fluid storage compartment of the housing 11 as fluid is displaced upon inversion of the container 22, until the fluid displacement from the container effects a predetermined pressure differential between the interior and exterior of the container. When sufficient fluid has been discharged from the container that the pressure differential between the interior and exterior of the container reaches the predetermined level, air will begin to flow into the container through the fluid discharge opening 20.

To prevent air from entering into the container through the fluid discharge opening 20, the check valve 18 in the base of the container is designed to actuate, thereby allowing air flow into the container through the check valve opening 22, at a pressure differential between the interior and exterior of the container which is less than the aforementioned predetermined pressure differential at which air will flow into the container through the fluid discharge opening 20. Hence, when the container of the present invention is inverted, the fluid discharge opening 20 is sufficiently large that fluid will begin to flow out of the container through the fluid discharge opening 20. As the fluid is displaced, the pressure differential between the interior and exterior of the container rises. The check valve actuates prior to the pressure differential reaching the predetermined pressure differential at which air will flow up through the fluid discharge opening. The actuation of the check valve allows air to enter the fluid storage compartment of the housing, which reduces the pressure differential between the interior and exterior of the container, so as to prevent the pressure differential from increasing to the predetermined pressure differential at which air will flow up through the fluid discharge opening 20.

If the fluid discharge opening 20 is made too large, air will readily flow into the container through the fluid discharge opening prior to the interior and exterior pressure differential becoming great enough to actuate the check valve. This will allow air to flow into the container through the fluid discharge opening, which results in decreased fluid output rate through the fluid discharge opening. Likewise, if the check valve actuates at a pressure differential greater than the predetermined pressure differential at which air will flow into the container through the fluid discharge opening, then upon sufficient fluid displacement from the container, air will flow into the container through the fluid discharge opening, which will reduce the pressure differential, whereby the check valve never actuates.

The fluid discharge opening allows flow of an initial portion of the fluid from the interior fluid storage compartment through the discharge opening upon simple inversion of the container without squeezing of the container to create a pressure differential. After sufficient fluid displacement from the container, a sufficient pressure differential is created between the interior and exterior of the container to actuate the check valve to introduce air into the container from the bottom of the container.

Figure 7:
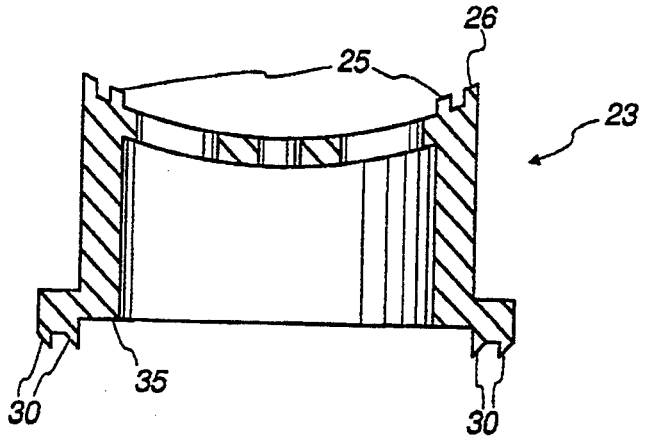
FIG. 7 is a sectional view of a check valve housing embodying various features of the present invention.
Figure 8:
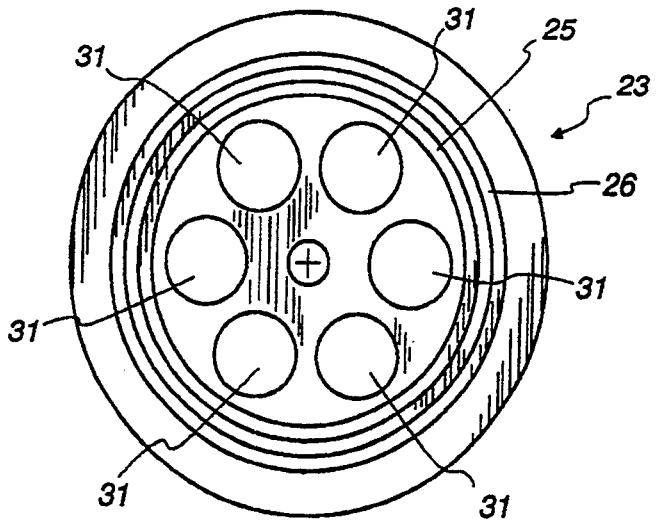
FIG. 8 is a top, plan view of the check valve housing of FIG. 7.
Figure 9:
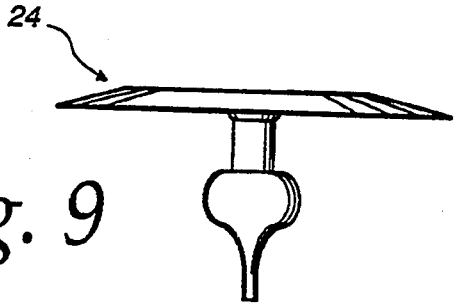
FIG. 9 is a side elevational view of a seating element for use with the check valve housing of FIG. 7.
Figure 10:
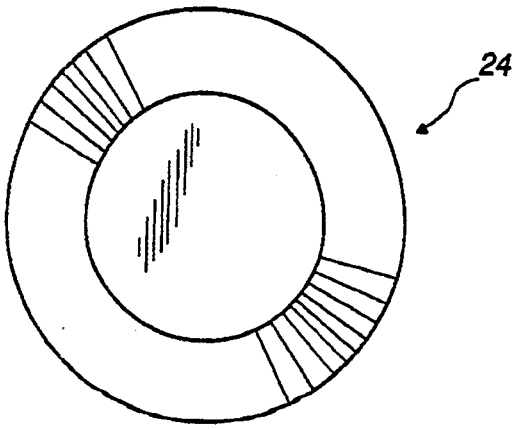
FIG. 10 is a top, plan view of the seating element of FIG. 9.

A check valve which has been found particularly well suited for use with the container of the present invention is illustrated in FIGS. 7–10. The check valve housing 23 is illustrated in FIGS. 7 and 8, and a complementary seating element 24 is illustrated in FIGS. 9 and 10. With reference to FIGS. 7 and 9, the seating element 24 is disposed radially inwardly of the outer lip 26 and seats against annular seating surface 25 of the valve housing 23. The annular seating surface 25 is recessed from the outer annular lip 26 of the valve housing 23 to prevent its unseating from the seating surface 25 unintentionally due to lateral water currents or the like a plurality of apertures 31 are disposed radially inwardly of the seating surface 25. Fluid inside the container biases the seating element 24 against the seating surface 25 to prevent fluid from being discharged through the bottom of the container when the container is in its upright position. Air flow from outside the container toward the interior of the container displaces the seating element 24 from the seating surface 25 to allow air flow into the container when the container is inverted. That is, the outer lip 26 serves as a barrier to such currents to prevent the water from pushing between the seating surface 25 and the seating element 24 and breaking the water-tight seal. In this regard, the seating element 24 is tapered to minimize the thickness of the seating element at its periphery to further prevent the seating element from being displaced by lateral fluid currents. This is particularly important in applications such as bicycle water bottles, wherein the containers are subject to considerable vibration and shaking. Also, one of the requirements for water bottles, which is not a consideration for containers such as baby bottles or the like, is that water bottles typically are required to store fluids for extended lengths of time, on the order of several hours or longer. The check valve of the present invention is designed such that it allows long term storage of fluids without significant leakage of fluid through the bottom of the container.

The seating element is preferably made of a flexible material such as silicon having a durometer value of approximately 60. The check valve housing 23 is preferably made of low density polyethylene. Projections 30 extend from the bottom 31 of the check valve housing 23 to facilitate ultrasonic welding of the check valve to the container housing, which is the preferred method of attachment in order to prevent heat warpage of the check valve which may diminish its effectiveness. In this regard, it is desirable that the seating surface 25 be spaced sufficiently from the bottom 31 of the check valve housing 23 that the seating surface 25 is structurally unaffected by the attachment of the check valve to the container housing. Alternatively, the check valve may be threadably engaged to the container to allow its removal for washing, sterilization or the like.

The container of the present invention allows the user to simply invert the container and thereby obtain a steady stream of flow of the fluid from the container, without the need for squeezing the container, without sucking fluid from the container, and without performing any other functions in addition to simply inverting the container. Hence, with the container of the present invention, a bicyclist can simply pick up the container and invert it to obtain a steady, uninterrupted flow of replenishing fluid, without concern for the rotational position of the bottle, and without the necessity of squeezing or sucking on the container, which requirements are undesirable and hazardous in activities such as high speed bicycling. Applicant's container also provides a steady, uninterrupted flow of fluid from the container throughout repeated squeezing and releasing of the container, which is not obtainable with containers of the prior art.

As shown in the figures, the bottle means 10 comprises a cylindrical shaped flexible housing 11 that contains a narrowed neck 12. The housing 11 comprises a reservoir for retaining fluids. A removable cap 13 is attached to the bottle means 10 at the narrowed neck end. It is held in position when detached from the bottle means 10 by a loop 14 which fits around the slightly widened upper end of the neck 14. A flexible strap 15 is attached to the cap 13 and the loop 14. The cap 13 also contains a lip 16 to assist the user in attaching and detaching the cap 13 from the bottle means. The cap 13 also contains a shut off valve 17 which can be opened or closed to allow fluid passage through the valve 17. A one way check valve 18 is positioned in the base 19 of the bottle means. This valve also allows air into the bottle and permits direct contact between the air and the fluid in the flexible housing reservoir but will not permit fluid to flow out of this valve. The valve can be a separate device that is attached to an aperture in the base of the bottle means, or it can be molded in position in a plastic manufacturing mold. The advantage of having the valve as a separate entity is the ease with which the bottle and valve can be cleaned.

In use, the bottle can be held in a bottle holder on the frame of a bicycle. When the individual riding the bicycle wishes to have a drink of water, he or she takes the bottle from the holder, opens the fluid flow shut off valve and squeezes the bottle. As long as the bottle is inverted, the fluid will flow out. Squeezing the bottle will increase the flow of the fluid stream, but it is not necessary for the basic flow from the bottle. Another embodiment of this invention would be a baby bottle design that would allow a smooth flow of fluid.

While I have described my invention in connection with specific embodiments thereof, it is clearly to be understood that this is done only by way of example and not as a limitation to the scope of my invention as set forth in the objects thereof and in the appended claims.

I claim:

1. A water bottle for storing and dispensing fluids, comprising:

a container housing;

said container housing defining a fluid storage compartment and having an upper end and a lower end, and having an interior and an exterior;

said upper end of the container housing having a fluid discharge opening in fluid communication with the interior fluid storage compartment;

said lower end of the container housing having an aperture in fluid communication with the interior fluid storage compartment;

a check valve disposed within said aperture at the lower end of said container housing, the check valve substantially blocking said lower end aperture when the container is in its upright position to prevent fluid stored in said fluid storage compartment from passing through said lower end aperture, the check valve having means for actuating to allow passage of air through the lower end aperture directly into the fluid storage compartment of the housing upon realization of a predetermined pressure differential between the interior and the exterior of the fluid storage compartment; and said discharge opening being unobstructed to allow flow of an initial portion of the fluid from the interior fluid storage compartment through the discharge opening upon inversion of the container without squeezing of the container, the unobstructed discharge opening being sufficiently narrow to prevent air flow into the storage compartment of the container through the discharge opening upon said flow of fluid through the discharge opening until the pressure differential between the interior and exterior of the fluid storage compartment realized from said fluid flow exceeds said predetermined pressure differential required to actuate the check valve the check valve thereby actuating prior to air flow through the discharge opening to allow flow of a steady stream of the fluid from the fluid storage compartment through the discharge opening without air flowing into the fluid storage compartment through the discharge opening upon inversion of the container.

2. A container in accordance with claim 1, wherein said container housing is substantially cylindrical and has a central axis, and the fluid flows from the storage compartment of the housing through the discharge opening upon inversion of the container regardless of the rotational position of the container housing about its central axis.

3. A container in accordance with claim 1 wherein said container housing comprises a flexible material and the rate of flow of the fluid from the interior storage compartment through the discharge opening upon inversion of the container increases upon squeezing of the flexible housing material.

4. A container in accordance with claim 1 wherein said container housing comprises a cap which is detachably engageable at the upper end of the container housing and which defines said discharge opening.

5. A container in accordance with claim 4 wherein the container housing comprises a narrowed neck portion and said cap is tethered to the narrowed neck portion of the container housing to prevent its separation from the container housing.

6. A container in accordance with claim 1 wherein said housing comprises a shut off valve in operable engagement with the discharge opening and manually operable between an open position in which the shut off valve allows fluid flow through the discharge opening and a closed position in which the shut off valve prevents fluid flow through the discharge opening.

7. A container in accordance with claim 1 wherein the check valve is manually detachable and engageable from the aperture in the lower end of the container housing to facilitate cleaning of the container housing and check valve.

* * * * *